US006338564B1

(12) United States Patent
Jordan et al.

(10) Patent No.: US 6,338,564 B1
(45) Date of Patent: Jan. 15, 2002

(54) OPTICAL HOUSING WITH VERTICAL LIGHT SOURCE

(75) Inventors: David L. Jordan, Boones Mill; Gerry F. Thornton, Christiansburg, both of VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/517,008

(22) Filed: Feb. 28, 2000

(51) Int. Cl.[7] ..... F21V 7/00
(52) U.S. Cl. ..... 362/346; 362/297; 362/304
(58) Field of Search ..... 362/297, 346, 362/347, 304, 306, 320, 362, 341, 296

(56) References Cited

U.S. PATENT DOCUMENTS 4,242,727 A * 12/1980 de Vos et al. ..... 362/347 X
4,575,788 A * 3/1986 Lewin ..... 362/347 X
4,979,086 A * 12/1990 Heinisch ..... 362/297
5,287,259 A * 2/1994 Lautzenheiser ..... 362/346 X
5,938,317 A * 8/1999 Thornton ..... 362/346 X
5,988,836 A * 11/1999 Swarens ..... 362/320 X
6,024,469 A * 2/2000 Greif ..... 362/346
6,036,338 A * 3/2000 Gordin ..... 362/346 X
6,042,250 A * 3/2000 Stragnola ..... 362/346 X
6,152,579 A * 11/2000 Reed et al. ..... 362/346 X

* cited by examiner

*Primary Examiner*—Laura Tso
(74) *Attorney, Agent, or Firm*—Marks S. Bicks; Jeffrey J. Howell

(57) ABSTRACT

An optical housing is formed from a blank and a reflector mounting plate. The blank is scored to allow it to be folded into a box with a base and four walls. The box has a circular hole in the base and two wall tabs at the end of each of the four walls. The reflector mounting plate has wall tab slots that receive the wall tabs from the four walls and couples the two parts of the housing together. A set of reflectors is mounted to the reflector mounting plate in a predetermined reflector pattern. Another set of reflectors is mounted to the base of the box in a circular pattern. A third reflector fits into the circular hole in the base of the box and is mounted to the base. A light source is attached to the base of the box and extends vertically through a hole in the third reflector and partially beyond the first set of reflectors.

34 Claims, 13 Drawing Sheets

OPTICAL HOUSING WITH VERTICAL LIGHT SOURCE

FIELD OF THE INVENTION

The present invention relates to an overhanging luminaire or light fixture for both indoor and outdoor use. The light fixture has a two piece optical housing including a blank folded into a box with a base and four walls, and a reflector mounting plate coupled to the four walls. A set of reflectors is mounted to the reflector mounting plate such that a light source extends vertically in the center of and partially beyond the set of reflectors.

BACKGROUND OF THE INVENTION

Overhanging light fixtures are common to the lighting industry. Conventional light fixtures have optical housings in which the walls, the base and the reflector mounting plate are separately manufactured. The separate pieces must then be assembled using any of various methods, such as, fasteners, bent tabs, welding, brackets or glue. These optical housings can be difficult and time consuming to assemble and costly to manufacture.

In addition, conventional optical housings have light sources where the entire length of the light source is laterally surrounded by reflectors. The light source is mounted either horizontally or vertically at the pinnacle of the reflector assembly. This design requires a powerful light source to provide the proper light beam configuration and creates a significant amount of light pollution.

SUMMARY OF THE INVENTION

Accordingly, an object of the present invention is to provide a light fixture with a two piece optical housing having walls that are unitarily formed with the base along folds, thereby reducing the manufacturing and assembly time and expense.

Another object of the present invention is to provide a light fixture with an optical housing having a vertical light source that partially extends beyond the reflectors, reducing the power required for lighting and reducing the light pollution emitted.

The foregoing objects are basically attained by providing an optical housing with a base and four walls, each wall is coupled to the base along a unitary fold. A reflector mounting plate is coupled to the walls with reflectors mounted to the reflector mounting plate in a predetermined reflector pattern. A light source extends approximately in the center of the reflectors.

By forming the optical housing in this manner, the housing is reduced to two pieces that are easy to manufacture and assemble. The housing may be stored flat with the walls and base in an unfolded configuration, increasing the number of housings that may be stored over conventional housings stored in a standard assembled box configuration. Additionally, the housing uses a relatively low power light source to create the desired light beam configuration, while simultaneously reducing light pollution.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring to the drawings which form apart of this disclosure.

DETAILED DESCRIPTION OF THE PREFERRED EMBODIMENT

Figure 1:
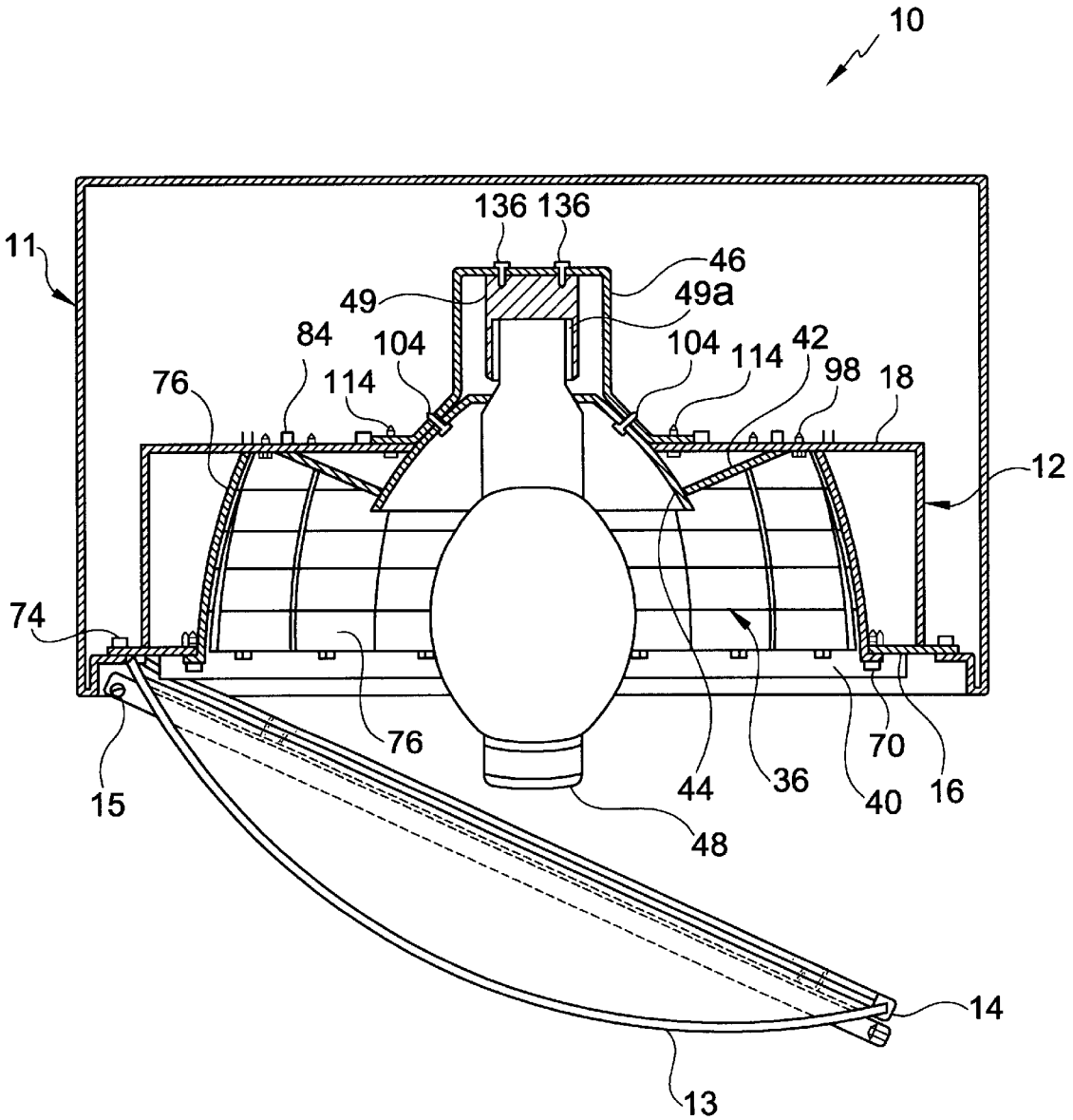
FIG. 1 is a side elevational view in section of the light fixture in accordance with a first embodiment of the present invention.

Referring initially to FIGS. 1–11, a light fixture 10 according to a first embodiment of the present invention has a mounting housing 11 with an optical housing 12 and a lens 13 encased in lens frame 14 coupled to it. Lens frame 14 is pivotally hinged through screw 15 to mounting housing 11, allowing access to the optical housing. Optical housing 12 comprises a reflector mounting plate 16 and a base 18 with four walls 20, 22, 24, and 26 attached to base 18 along unitary fold lines 28, 30, 32, and 34. Reflector mounting plate 16 is coupled to walls 20, 22, 24, and 26 and has reflector set 36 mounted to it in reflector pattern 38. A reflector strip 40 is mounted to reflector mounting plate 16 in a generally circular pattern around reflector pattern 38. A reflector set 42 extends from base 18 in a circular pattern, while a reflector 44 is mounted by bracket 46 in the center of reflector set 42. A light source 48, mounted to bracket 46, extends through the center of reflector 44.

Figure 5:
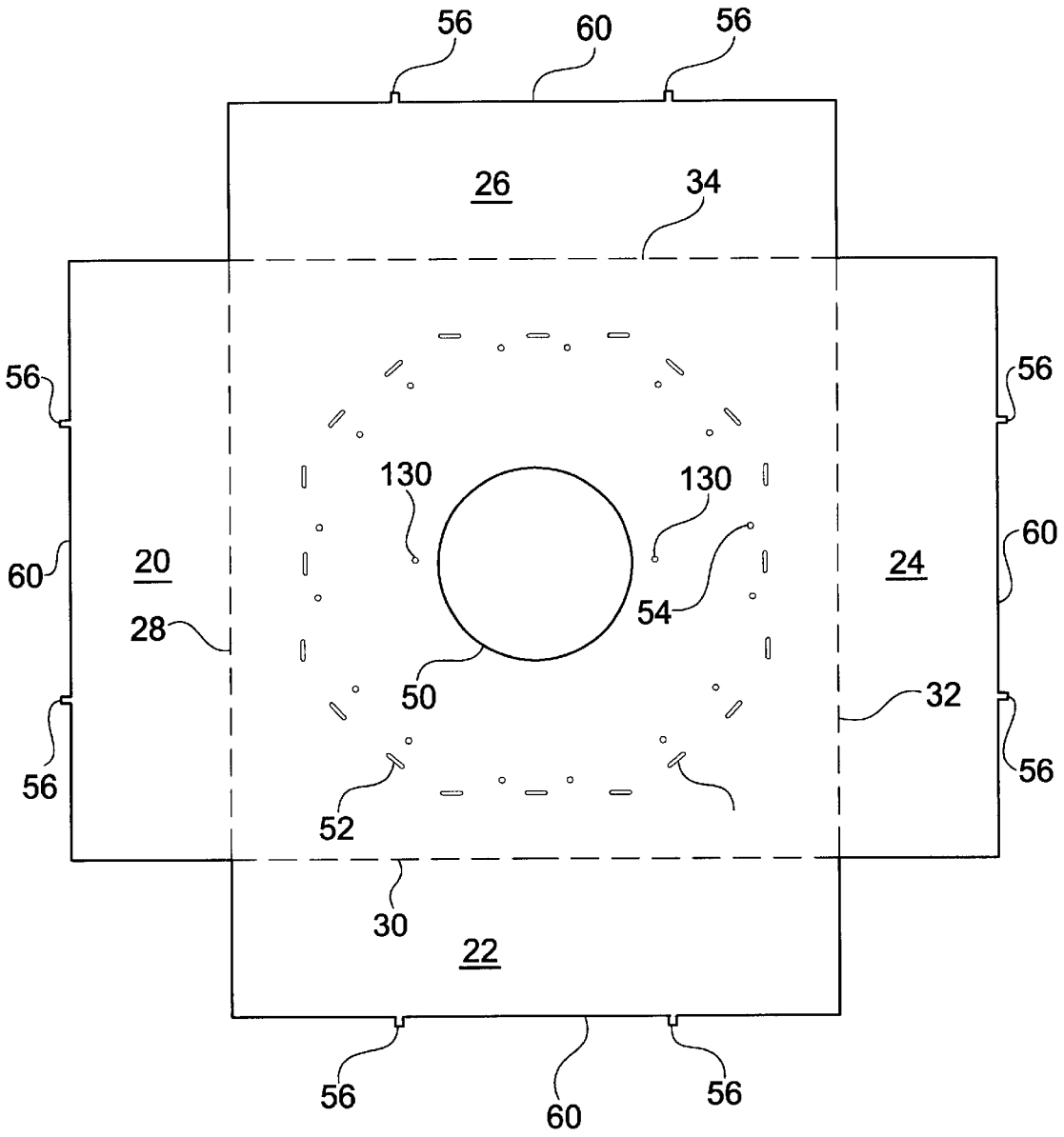
FIG. 5 is a top plan view of the blank, including the base and four walls, for the optical housing illustrated in FIG. 3, prior to assembly.
Figure 6:
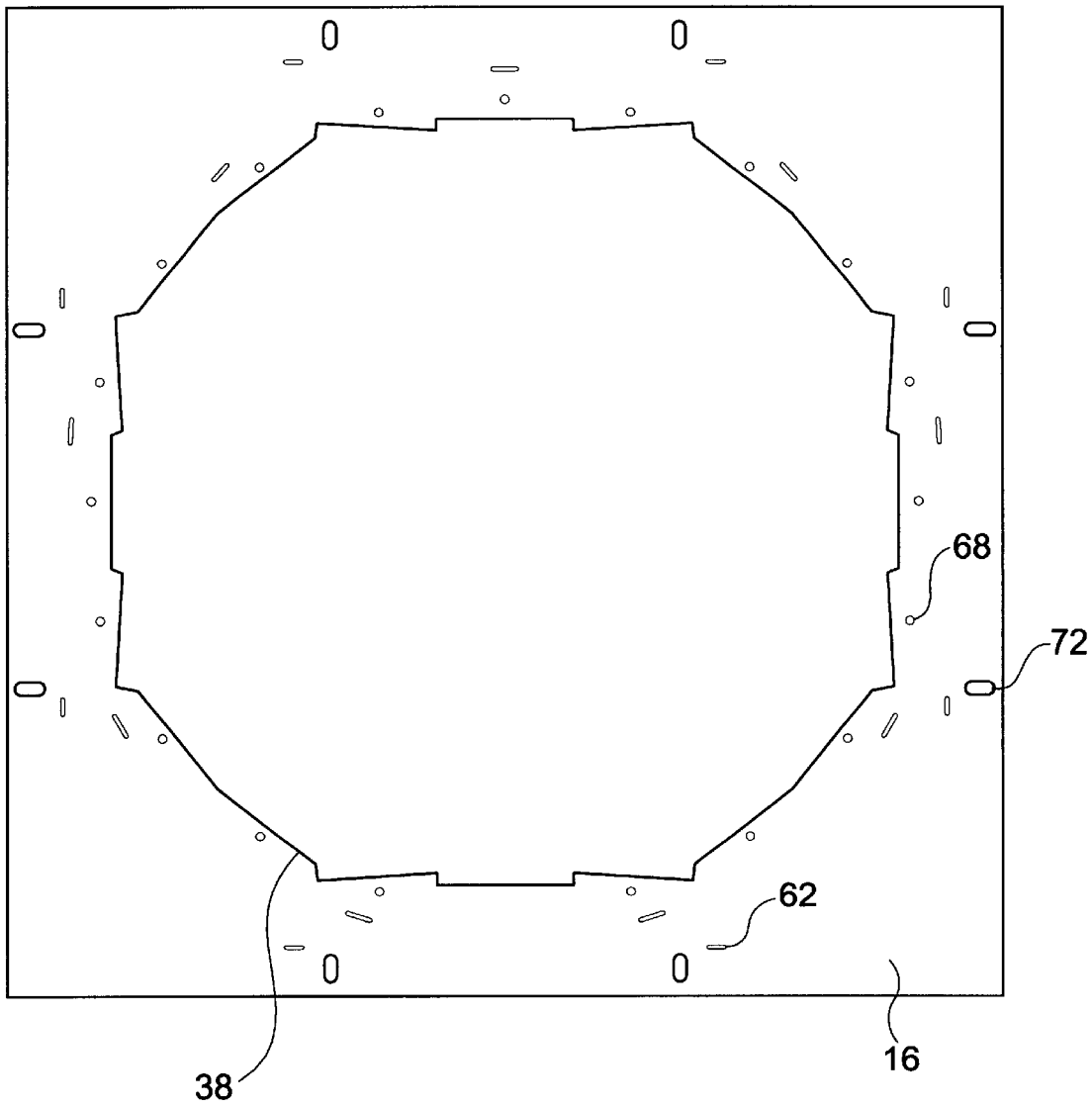
FIG. 6 is a bottom plan view of the reflector mounting plate illustrated in FIG. 2, prior to assembly.

Base 18 and walls 20, 22, 24, and 26 of optical housing 12 are manufactured as a flat planar metal blank (FIG. 5). Base 18 is preferably square with a circular hole 50 in its center, but may be any suitable design, such as a rectangle. Small tab slots 52 extend through base 18 and are arranged in a pattern similar to reflector pattern 38 around hole 50. Slots 52 hold one side of each reflector 76 in reflector set 36. Additionally, base 18 has screw holes 54 oriented in a circular pattern around hole 50, inside of and in close proximity to reflector pattern 38 for mounting reflector set 42.

Walls 20, 22, 24, and 26 are manufactured coplanar with base 18 and extend therefrom. Unitary fold lines or scores 28, 30, 32, and 34 extend the length of the walls and separate the walls from the base. The walls are rectangular in shape, and each wall has two tabs 56 extending from edge 60 opposite the respective fold line.

Reflector mounting plate 16 (FIG. 6) is a flat planar metal plate with reflector pattern 38 defining the interior of optical housing 12. The reflector mounting plate is preferably square. Each reflector mounting plate edge is slightly longer than each edge of base 18, creating a plate with an area slightly larger than the area encompassed by walls 20, 22, 24, and 26. However, mounting plate 16 may be of any suitable shape as long as it is generally the same shape and slightly larger than base 18. Small tab slots 62 extend through mounting plate 16 near its periphery, and are sized to receive tabs 56 of walls 20, 22, 24, and 26. Rectangular tab slots 64 are slightly longer than slots 62. Slots 64 surround reflector pattern 38 and receive and hold tabs 106 of reflector strip 40. Screw holes 68 in mounting plate 16 also surround reflector pattern 38, but are closer to reflector pattern 38 than slots 64. Each reflector in reflector set 36 is mounted to reflector mounting plate 16 by screw holes 68 and screws 70. Holes 72 at the edge of mounting plate 16 and screws 74 mount the optical housing to mounting housing 11.

Figure 3:
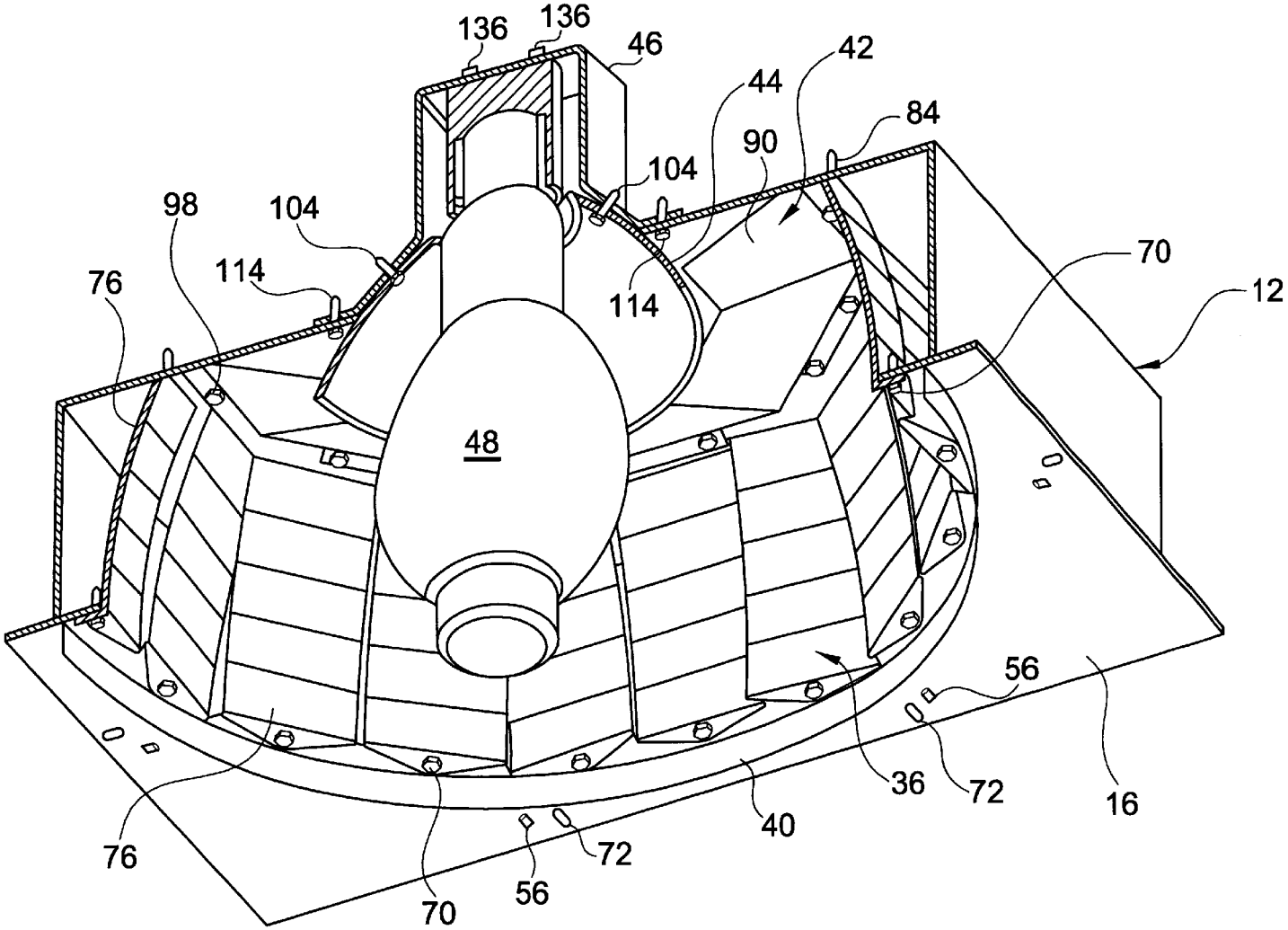
FIG. 3 is a bottom perspective view in section of the optical housing illustrated in FIG. 2.
Figure 7:
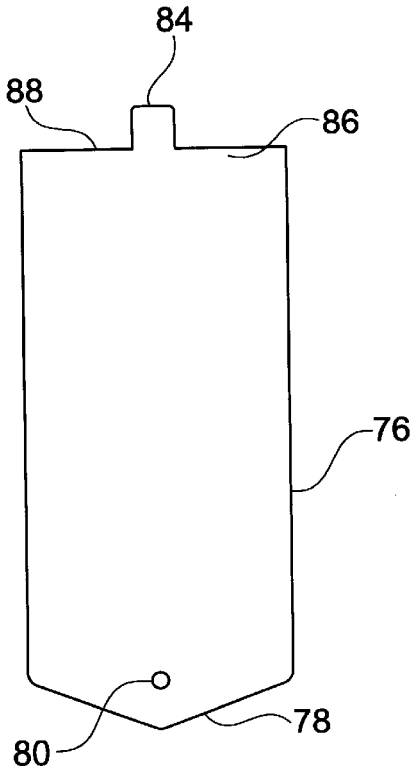
FIG. 7 is a front elevational view of the first reflector illustrated in FIG. 2.

Reflector set 36 preferably comprises twenty reflectors 76, as shown in FIG. 7. Reflector set 36 is not limited to twenty reflectors and can contain any number of reflectors as long as the reflectors produce the desired light beam pattern. Each reflector 76 is a generally rectangular metal sheet tapered to a point at end 78. As shown in FIGS. 1 and 3, end 78 is bent to an approximately ninety degree angle and is attached to reflector mounting plate 16 by hole 80 and screw 70. Each reflector has a curved configuration to allow the proper reflective properties and has tab 84 extending from end 86. Tab 84 is in the center of each edge 88 and is received within one tab slot 52 of base 18 holding end 86 of each reflector 76 in the proper reflector pattern.

Figure 8:
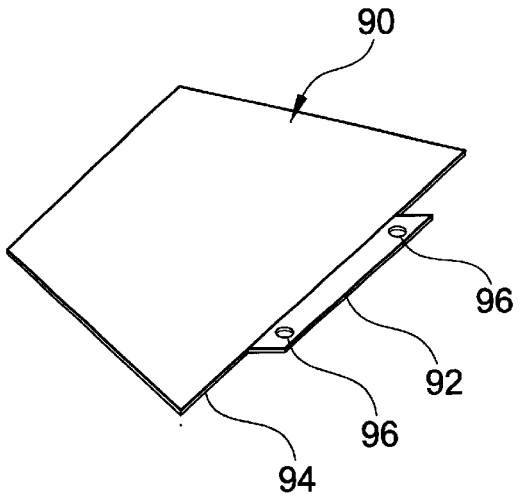
FIG. 8 is a bottom perspective view of the second reflector illustrated in FIG. 2.

Reflector set 42 preferably comprises eight reflectors 90, as shown in FIG. 8. Reflector set 42 is not limited to eight reflectors and can contain any number of reflectors as long as the reflectors produce the desired light beam pattern. Each reflector 90 is a trapezoidal planar metal sheet with tab 92 extending from edge 94 at an obtuse included angle, as shown in FIG. 1. Each tab 92 has two screw holes 96 for mounting to base 18. Screws 98 pass through holes 96 and threadably engage base 18 through holes 54. Reflector set 42 forms a generally circular or octagonal pattern around hole 50.

Figure 9:
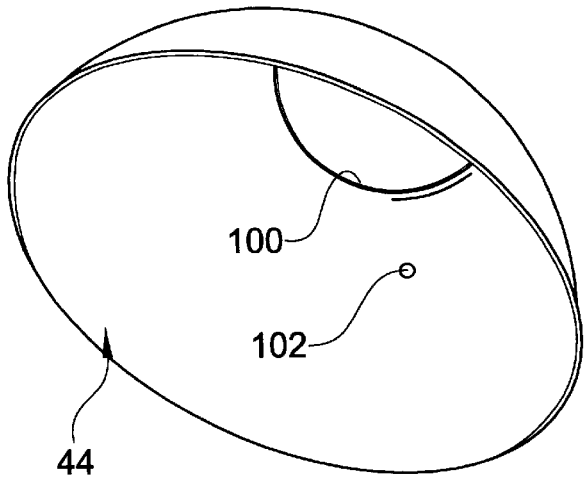
FIG. 9 is a bottom perspective view of the third reflector illustrated in FIG. 2.
Figure 10:
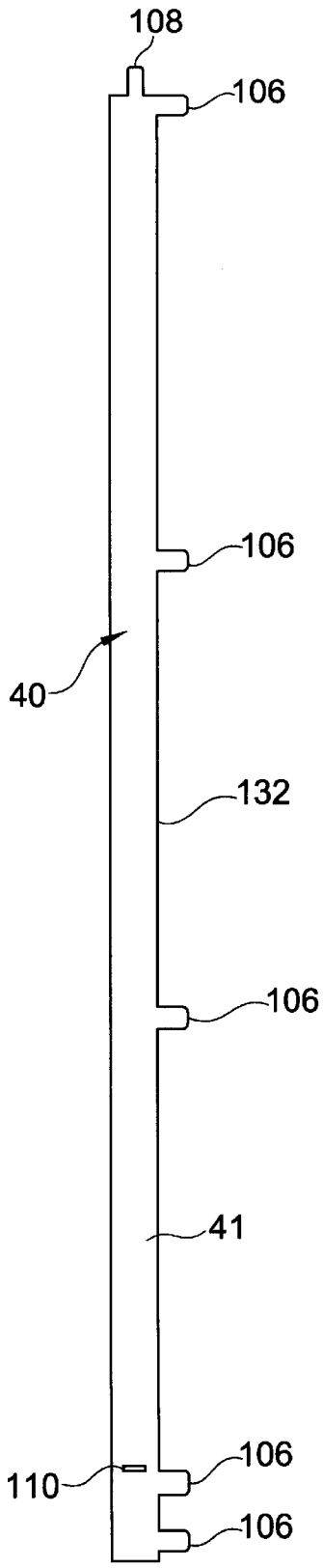
FIG. 10 is a side elevational view of the reflector strip illustrated in FIG. 2.

Reflector 44 is a metal generally faceted or frustoconically shaped reflector with hole 100 in the apex of the cone. As shown in FIGS. 3 and 9, reflector 44 has holes 102 in its side for mounting to bracket 46 by screws 104. Reflector 44 is partially inserted into hole 50 with a portion of the reflector inside optical housing 12 and below base 18 tapering to a portion of the reflector outside of optical housing 12 and above base 18. Hole 100 allows light source 48 to extend into the interior of optical housing 12, with its base outside housing 12.

Reflector strip 40 is a relatively long metal rectangular strip that extends perpendicularly from mounting plate 16 towards lens 13 when lens frame 14 is in a closed position, defining a space between strip 40 and lens 13. Strip 40 reflects high angle light out of the optical assembly, making the light fixture more efficient. Tabs 106 extend from side 41 of strip 40 and are received in slots 64 of mounting plate 16, coupling strip 40 to mounting plate 16. Reflector strip 40 also has tab 108 and tab slot 110. Tab 108 is inserted into slot 110 and holds strip 40 in a circular configuration around reflector pattern 38.

Figure 4:
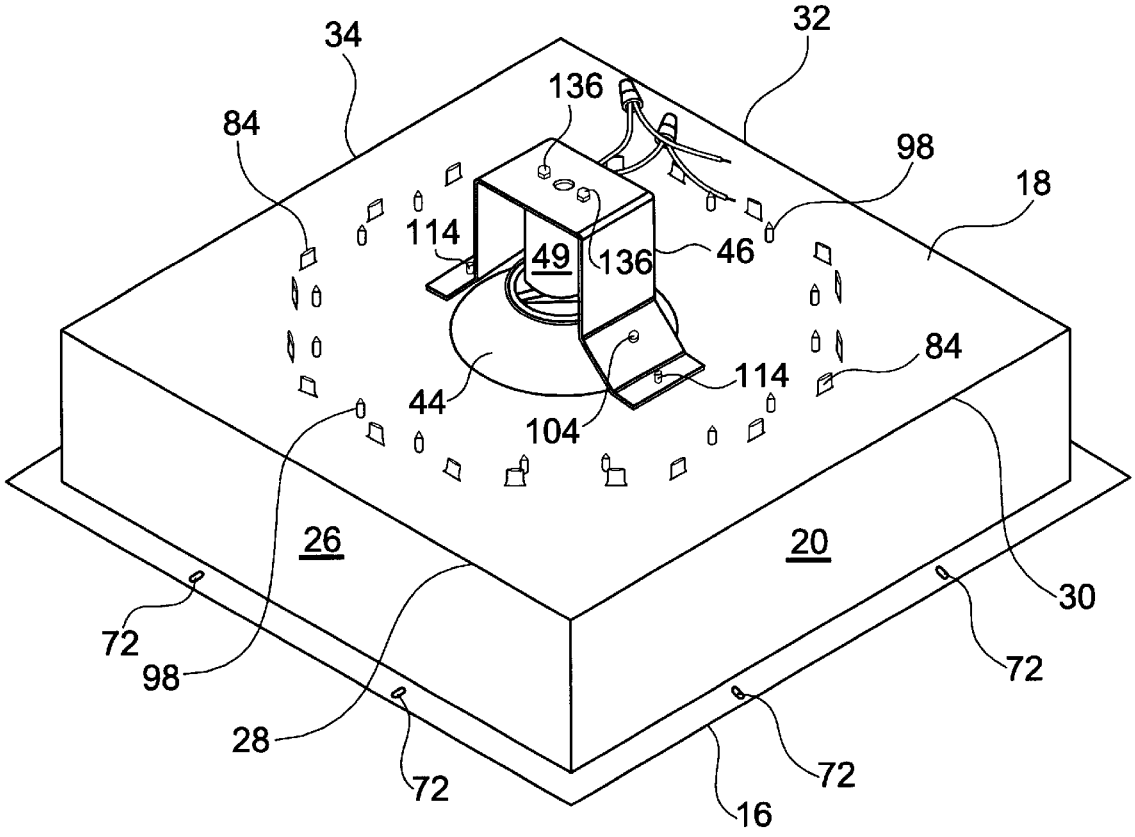
FIG. 4 is a top perspective view of the optical housing illustrated in FIG. 2
Figure 11:
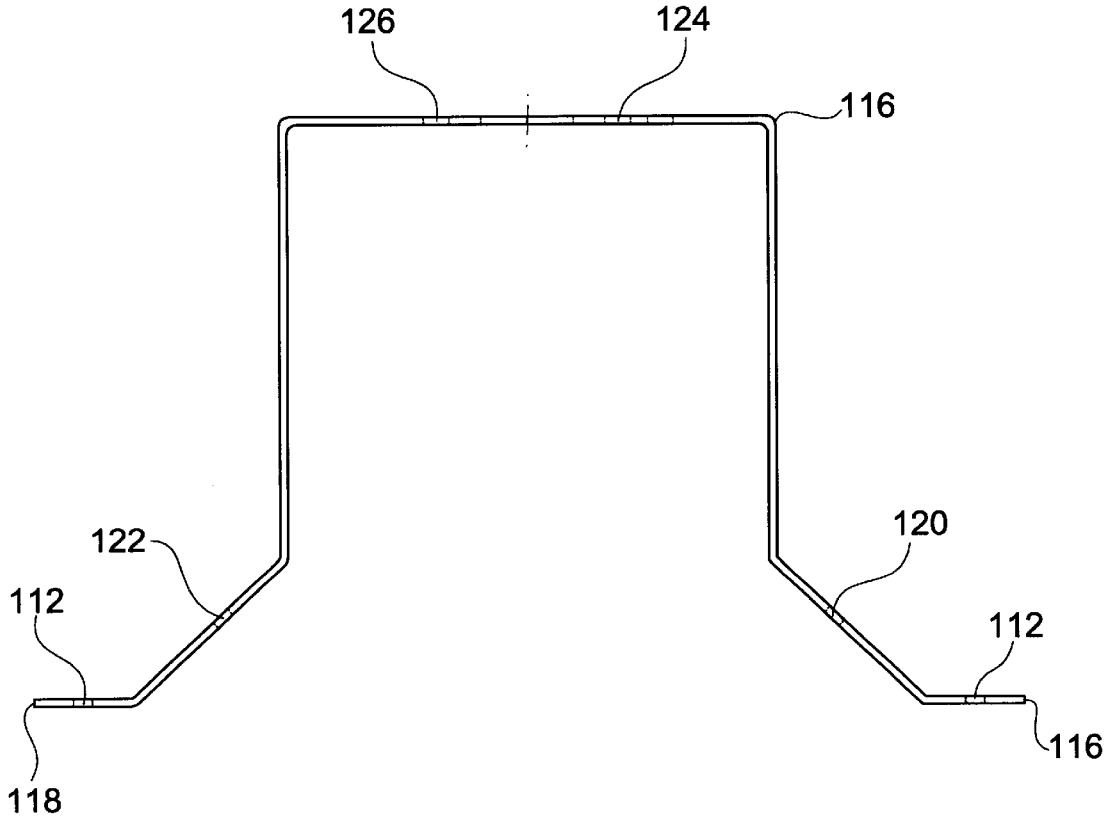
FIG. 11 is a side elevational view of the bracket illustrated in FIG. 4.

Bracket 46 is a generally U-shaped metal bracket that is mounted to base 18 by holes 112 and screws 114. As shown in FIGS. 4 and 11, bracket 46 has ends 116 and 118 that are each bent in two obtuse included angles creating a total bend of approximately ninety degrees. This total bend allows bracket ends 116 and 118 to be coplanar and adjacent to base 18. Bracket 46 spans hole 50 and has holes 120 and 122 for mounting reflector 44. Additionally, bracket 46 has holes 124 and 126 for mounting light mount 49.

Cylindrical light mount 49 has a socket 49*a*, is coupled to bracket 46 by screws 136, and depends from the bracket towards reflector 44. Light source 48 is coupled to light mount 49 by inserting light source 48 into socket 49*a* and vertically depends through hole 100 in reflector 44. As shown in FIG. 1, light source 48 extends partially beyond reflectors 36, allowing use of a less powerful light source than conventional light fixtures, while still producing the proper light beam configuration. The preferred power of the light source is either a 400 watt or 1000 watt metal halide lamp. It is possible to use a lower power light source if an extension is inserted. A less powerful lamp is generally shorter than the above mentioned lamps and since the placement of the light is critical, an extension would be required to allow the shorter, less powerful lamp to extend beyond the reflectors and produce the desired light beam configuration.

To assemble optical housing 12, walls 20, 22, 24, and 26 are folded along unitary fold lines 28, 30, 32, and 34, respectively. By folding each side to form a ninety degree angle with base 18, each wall abuts the two walls adjacent to it, forming a square box. Reflector mounting plate 16 is coupled to walls 20, 22, 24, and 26 by inserting tabs 56 into tab slots 62, creating a ninety degree angle between each wall and reflector mounting plate 16. Tabs 56 on each wall are then bent or folded over until each tab is parallel and rests against mounting plate 16. Folding tabs 56 couples the base and walls with the mounting plate and requires that mounting plate 16 abut edge 60 of each wall.

Each reflector 76 of reflector set 36 is then vertically mounted to both the base and the reflector mounting plate. Tab 84 of reflector 76 is inserted into tab slot 52 holding reflector 76 in place and allowing end 86 of reflector 76 to abut the base. Optionally, tab 84 may then be bent over in the same manner as tabs 56, coupling reflector 76 to base 18. Screw 70 is inserted into hole 80 of reflector 76 and into screw hole 68 in mounting plate 16, securing the reflector to the mounting plate. This procedure is repeated for each reflector in reflector set 36.

Figure 2:
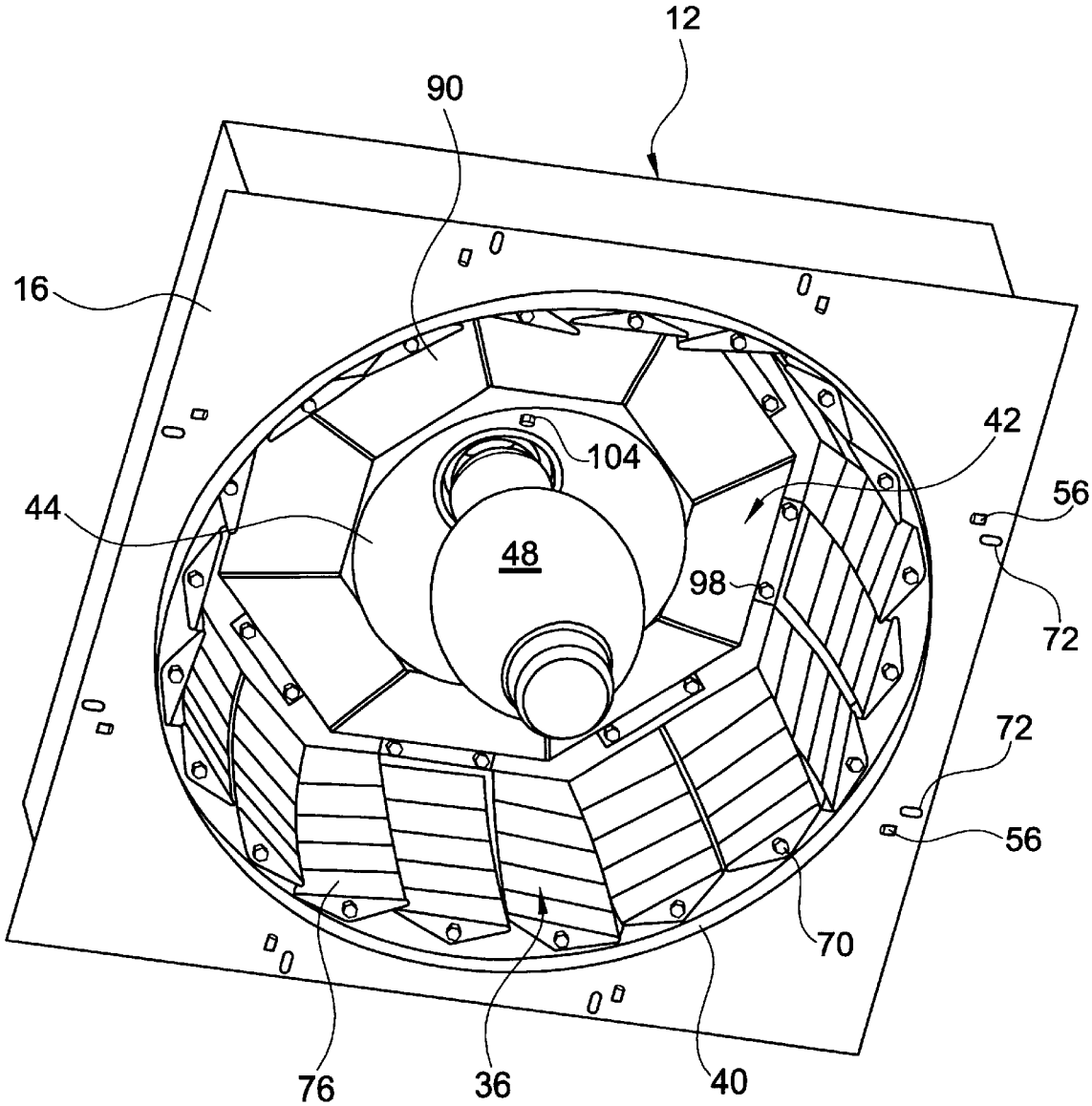
FIG. 2 is a bottom perspective view of the optical housing of the light fixture illustrated in FIG. 1.

As shown in FIG. 2, reflectors 90 are then mounted to base 18 in a circular or octagonal pattern around hole 50. Each reflector 90 is mounted by screws 98 passing through screw holes 96 and into holes 54 in base 18. Each tab 92 is parallel and adjacent to base 18, causing each reflector 90 to extend toward the center of optical housing 12 and reflector 44 and away from base 18 at an acute angle.

Reflector strip 40 is coupled to mounting plate 16 by inserting tabs 106 into tab slots 64 which are then bent in the same manner as described above for tabs 56. This causes strip 40 to abut mounting plate 16 for the entire length of edge 132. Tab 108 is inserted into slot 110 assisting tabs 106 in forming a circular pattern for reflector strip 40.

Bracket 46 is mounted to base 18 by screws 114. Screws 114 pass through holes 112 and threadably engage holes 130 in base 18. Reflector 44 is then mounted to bracket 46 by screw holes 120 and 122.

Light mount 49 is mounted to bracket 46 by screws 136 passing through holes 124 and 126 and threadably engaging light mount 49. Light source 48 is then inserted into light mount 49 and vertically extends through the center of reflector 44, reflector sets 38 and 42, and the center of optical housing 12. This reflector pattern and light configuration forms a type V Illuminating Engineering Society (IES) beam distribution.

Referring to FIGS. 12–15, according to a second embodiment of the present invention, optical housing 202 is manufactured and assembled similarly to optical housing 12. Optical housing 202 is comprised of base 204, walls 206, 208, 210, and 212, and reflector mounting plate 214, which are folded and coupled together as described above for optical assembly 12. Reflector 44, bracket 46, and light source 48 are all assembled and mounted as described above.

Figure 12:
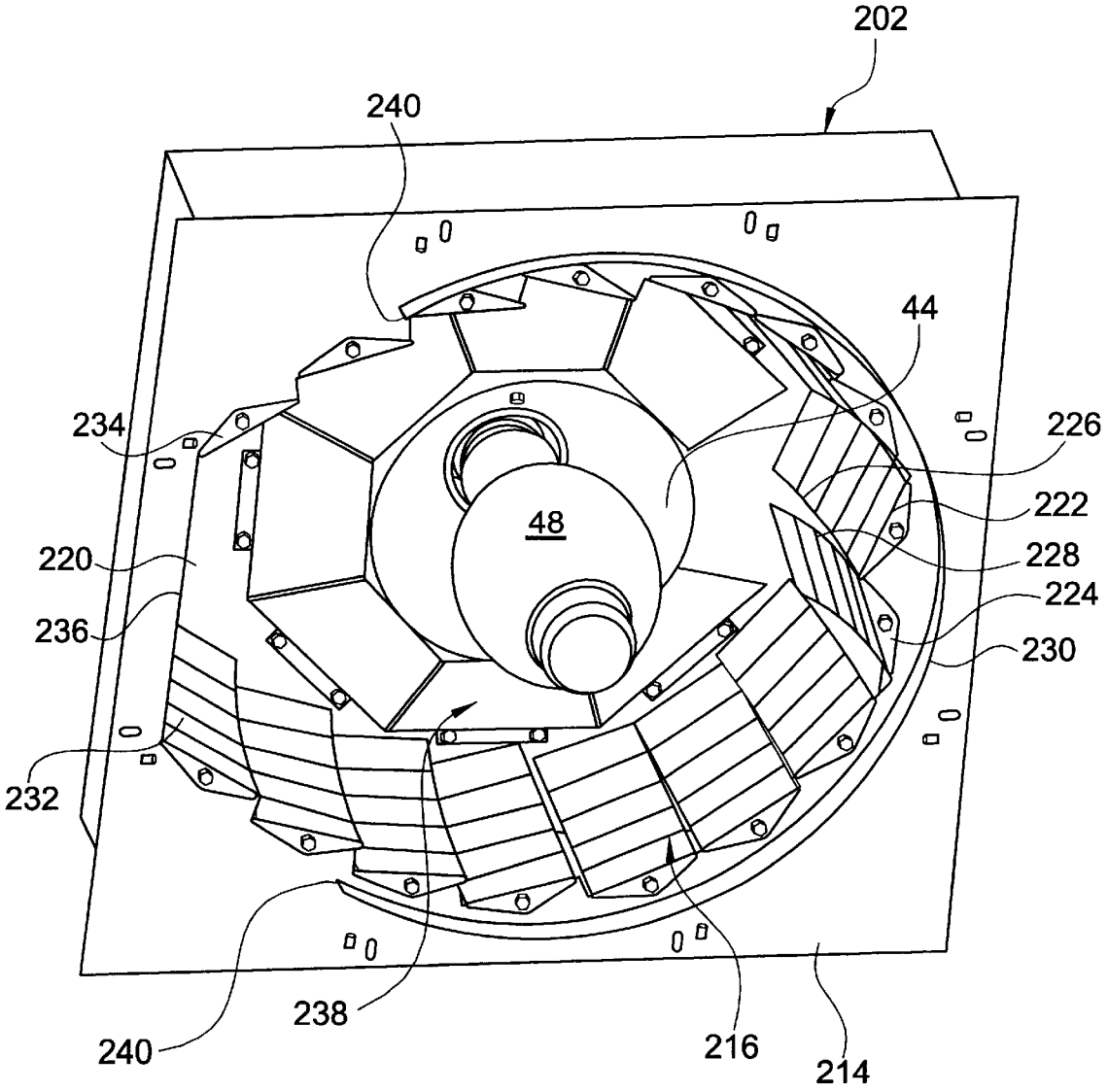
FIG. 12 is a bottom perspective view of an optical housing according to a second embodiment of the present invention.
Figure 13:
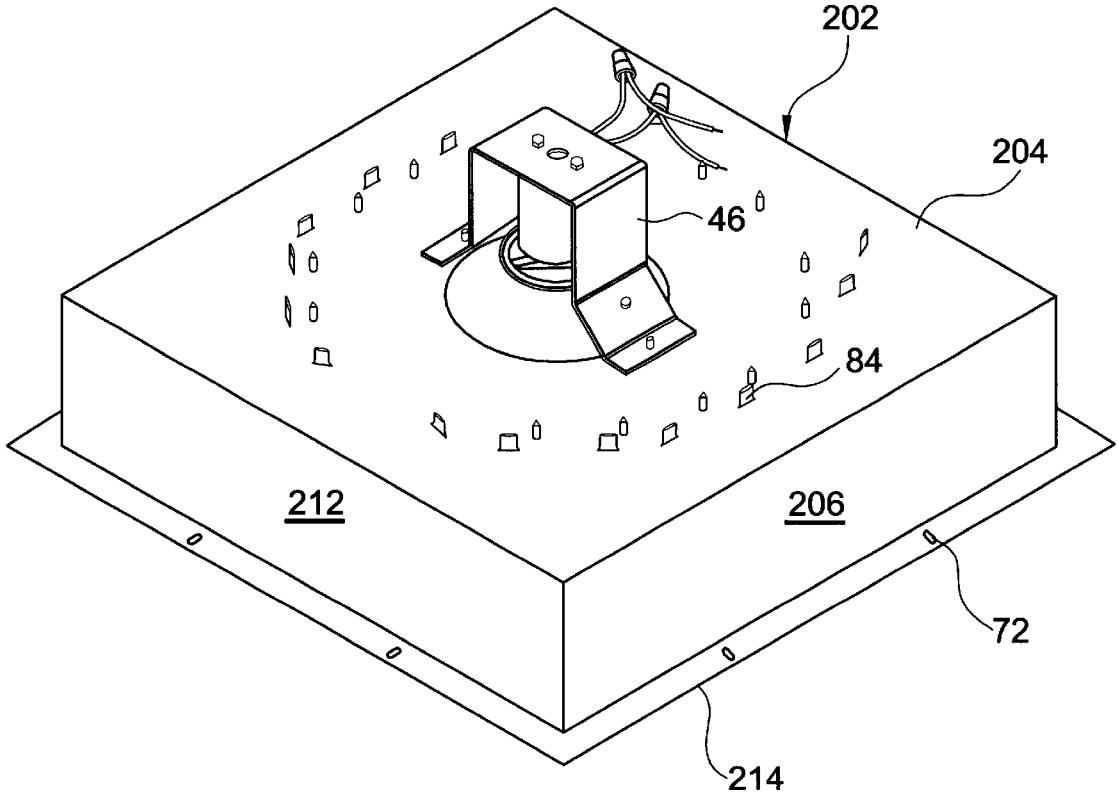
FIG. 13 is a top perspective view of the optical housing illustrated in FIG. 12.
Figure 14:
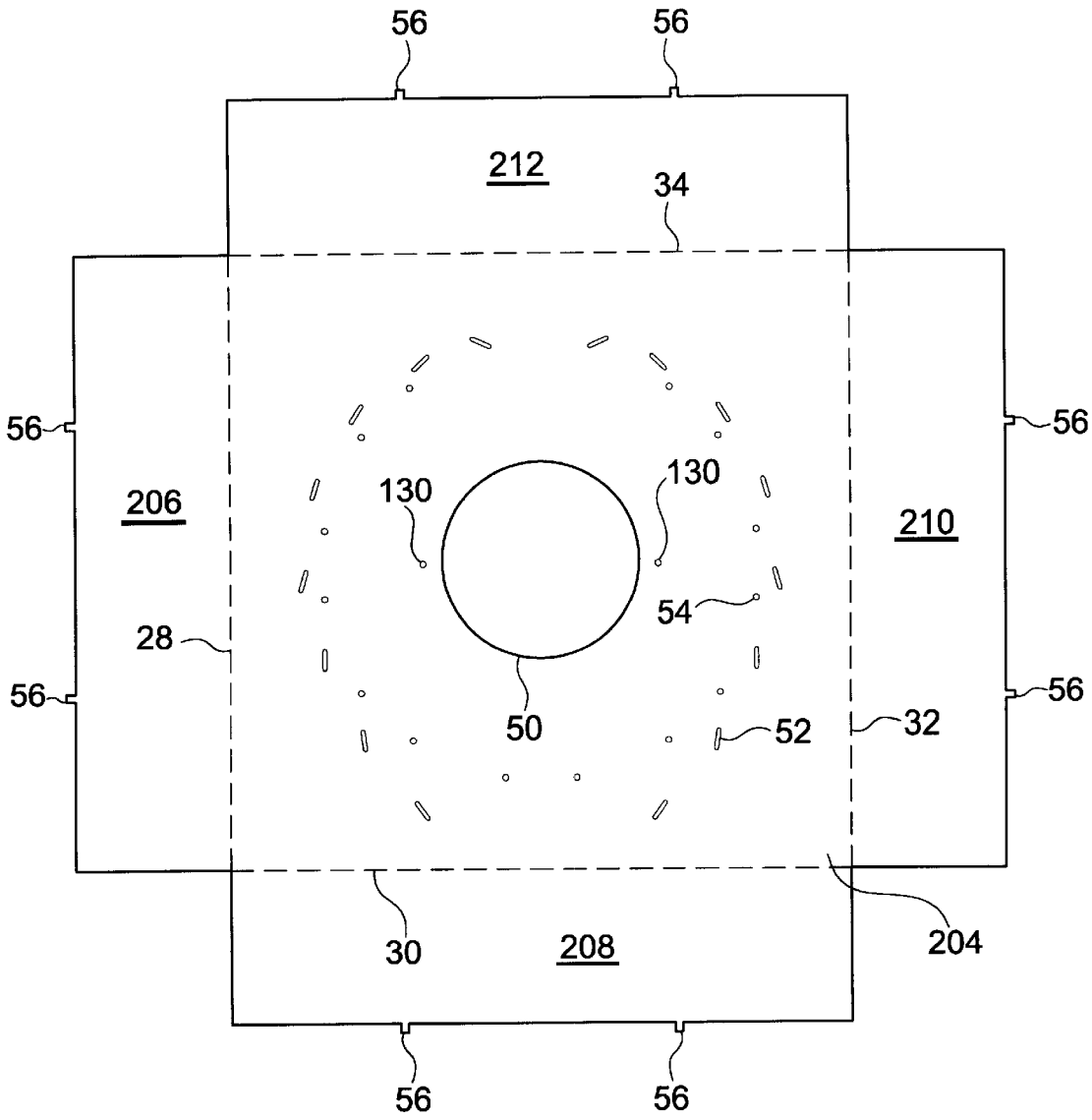
FIG. 14 is a top plan view of the blank, including the base and four walls, for housing illustrated in FIG. 12, prior to assembly.
Figure 15:
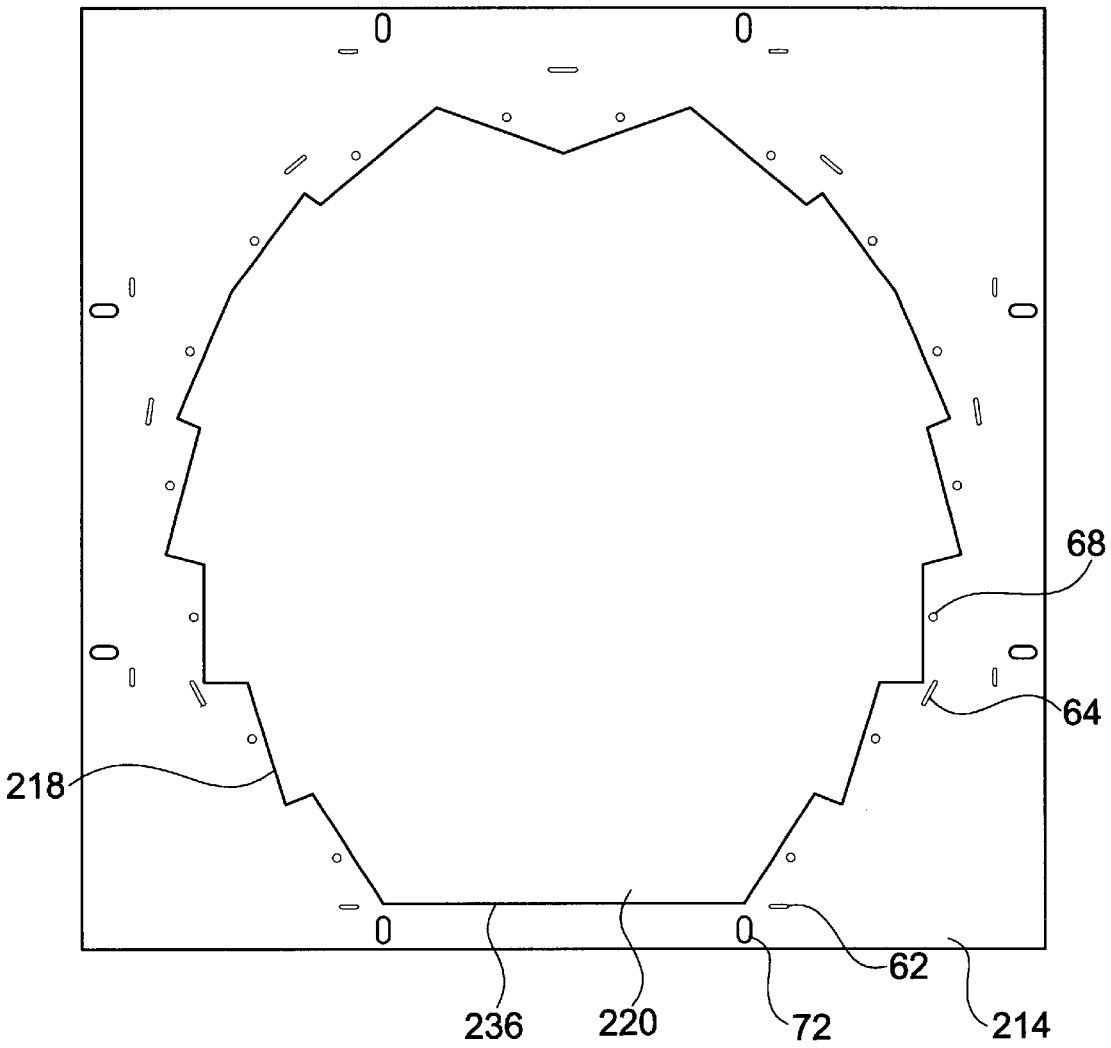
FIG. 15 is a bottom plan view of the reflector mounting plate illustrated in FIG. 12, prior to assembly.

Reflector set 216 is mounted similarly to reflector set 36, but in reflector pattern 218. Reflector set 216 is preferably comprised of sixteen individual reflectors identical to reflectors 76. Reflector set 216 is not limited to sixteen reflectors and may be comprised of any number of reflectors that achieves the desired light beam configuration. Each reflector 76 of reflector set 216 is mounted to the base 204 and the reflector mounting plate in the manner described for reflector pattern 38. As shown in FIG. 12, reflector pattern 218 has an open end 220, in which no reflectors are mounted. Reflectors 232 and 234 abut edge 236 of reflector pattern 218. In addition, reflectors 222 and 224 have respective edges 226 and 228 that are angled away from reflector strip 230 and towards light source 48. Reflector pattern 218 generally forms a U-shaped pattern with reflectors 222 and 224 forming an indentation in the bottom of the U.

Reflector set 238 is mounted in a similar circular pattern to reflector set 42. Each reflector in reflector pattern 238 is mounted to base 204 in the manner described for reflector 90. However, as shown in FIG. 12, no reflector is mounted adjacent to reflectors 222 and 224, creating an open ended semicircular pattern for reflector set 238 and making seven reflectors identical to reflectors 90, the preferred number of reflectors. Reflector pattern 238 is not limited to seven reflectors and may be comprised of any number of reflectors that achieves the desired light beam configuration.

Reflector strip 230 is mounted to reflector mounting plate 214 in the same manner as reflector strip 40. However, reflector strip 230 contours reflector pattern 218 and has an open end 240 and therefore does not engage itself.

The features of optical housing 202, which are similar to optical housing 12 are identified with like reference numbers. The same description of those similar features is applicable.

This light reflector pattern and light configuration results in a type III IES beam distribution. Either of the above disclosed embodiments may be modified to form a type I or IV IES beam distribution.

Although the preferred material for the optical housing and reflectors is a metal, such as aluminum, the optical housing and reflectors can be modify by manufacturing each piece with vacuum metalized plastic. However, it would be necessary to use a modified lower wattage light source than the preferred 400 or 1000 watt, due to high heat possibly melting the plastic material.

While specific embodiments have been chosen to illustrate the invention, it will be understood by those skilled in the art that various changes and modifications can be made therein without departing from the scope of the invention as defined in the appended claims.

What is claimed is:

1. An optical housing, comprising:

a base;

four walls, each wall coupled to said base along a unitary fold;

a reflector mounting plate coupled to said walls;

first reflectors mounted to said reflector mounting plate in a first reflector pattern;

a light source extending approximately in the center of said first reflectors; and second reflectors mounted to said base and arranged in a substantially circular pattern around said light source.

2. An optical housing according to claim 1 wherein said first reflectors are vertically mounted to said reflector mounting plate.

3. An optical housing according to claim 2 wherein each of said first reflectors has a reflector tab at one end.

4. An optical housing according to claim 3 wherein said base has tab slots receiving said reflector tabs to couple said first reflectors to said base.

5. An optical housing according to claim 4 wherein said tab slots are arranged in substantially the same pattern as said first reflector pattern.

6. An optical housing according to claim 1 wherein each of said four walls has at least one wall tab extending therefrom.

7. An optical housing according to claim 6 wherein said reflector mounting plate has tab slots receiving said wall tabs to couple said four walls to said reflector mounting plate.

8. An optical housing according to claim 1 wherein a third reflector is mounted to said base in a center of said second reflectors.

9. An optical housing according to claim 8 wherein said light source extends through a hole in a center of said third reflector.

10. An optical housing according to claim 9 wherein said light source is vertically held by a bracket coupled to said base.

11. An optical housing according to claim 10 wherein said light source extends partially beyond said first reflectors.

12. An optical housing, comprising:

a base having a substantially circular hole in a center thereof;

four walls coupled to said base along unitary folds, each of said walls having two wall tabs extending therefrom;

a reflector mounting plate having wall tab slots receiving said wall tabs to couple said walls and reflector mounting plate;

first reflectors mounted on said reflector mounting plate in a first reflector pattern;

second reflectors mounted on said base in a generally circular pattern;

a third tapered reflector mounted in a center of said second reflectors and having a hole extending therethrough; and a light source extending vertically through said hole in said third reflector and extending partially beyond said first reflectors.

13. An optical housing according to claim 12 wherein said first reflectors are vertically mounted on said reflector mounting plate.

14. An optical housing according to claim 13 wherein said first reflectors have a reflector tab at one end.

15. An optical housing according to claim 14 wherein said base has reflector tab slots receiving said reflector tabs to couple said base to said first reflectors.

16. An optical housing according to claim 15 wherein said reflector tab slots are arranged in a pattern substantially similar to said first reflector pattern.

17. An optical housing according to claim 12 wherein said third conical reflector is mounted in said hole in said base.

18. An optical housing according to claim 12 wherein said light source is coupled to said base by a bracket.

19. A method of assembling an optical housing, comprising the steps of:

forming a blank with four unitary fold lines, said unitary fold lines defining four rectangular extensions;

hand folding each of said extensions along said unitary fold lines, producing a box having a base and four walls;

coupling a reflector mounting plate to said four walls;

mounting first reflectors to said reflector mounting plate in a first reflector pattern;

mounting second reflectors to said base in a generally circular pattern; and vertically mounting a light source to said base in the center of said circular pattern, said light source extending partially beyond said first reflectors.

20. An optical housing, comprising:

base having tab slots;

four walls, each wall coupled to said base along a unitary fold;

a reflector mounting plate coupled to said walls;

first reflectors mounted to said reflector mounting plate in a first reflector pattern, each of said first reflectors having a reflector tab at one end; and a light source extending approximately in the center of said reflectors;

said tab slots receiving said reflector tabs to couple said first reflectors to said base.

21. An optical housing according to claim 20 wherein said first reflectors are vertically mounted to said reflector mounting plate.

22. An optical housing according to claim 20 wherein said tab slots are arranged in substantially the same pattern as said first reflector pattern.

23. An optical housing according to claim 20 wherein each of said four walls has at least one wall tab extending therefrom.

24. An optical housing according to claim 23 wherein said reflector mounting plate has tab slots receiving said wall tabs to couple said four walls to said reflector mounting plate.

25. An optical housing according to claim 20 wherein second reflectors are mounted to said base and arranged in a substantially circular pattern around said light source.

26. An optical housing according to claim 25 wherein a third reflector is mounted to said base in a center of said second reflectors.

27. An optical housing according to claim 26 wherein said light source extends through a hole in a center of said third reflector.

28. An optical housing according to claim 20 wherein said light source is vertically held by a bracket coupled to said base.

29. An optical housing according to claim 20 wherein said light source extends partially beyond said first reflectors.

30. An optical housing, comprising:

a base;

four walls, each wall coupled to said base along a unitary fold;

a reflector mounting plate coupled to said walls;

first reflectors mounted to said reflector mounting plate in a first reflector pattern; and a light source extending approximately in the center of said reflectors;

said first reflectors being vertically mounted to said reflector mounting plate;

each of said first reflectors having a reflector tab at one end.

31. An optical housing according to claim 30 wherein said first reflectors are vertically mounted to said reflector mounting plate.

32. An optical housing according to claim 30 wherein second reflectors are mounted to said base and arranged in a substantially circular pattern around said light source.

33. An optical housing, comprising:

a base;

four walls, each wall coupled to said base along a unitary fold;

a reflector mounting plate coupled to said walls;

first reflectors mounted to said reflector mounting plate in a first reflector pattern; and a light source extending approximately in the center of said reflectors;

each of said four walls having at least one wall tab extending therefrom.

34. An optical housing according to claim 33 wherein said reflector mounting plate has tab slots receiving said wall tabs to couple said four walls to said reflector mounting plate.

* * * * *